US010813417B2

(12) United States Patent
Quinn et al.

(10) Patent No.: US 10,813,417 B2
(45) Date of Patent: Oct. 27, 2020

(54) SNAP FASTENER RECEIVER TECHNIQUES

(71) Applicant: Love Your Melon Inc., Minneapolis, MN (US)

(72) Inventors: Zachary Quinn, Minneapolis, MN (US); Charles Carlisle, Minnapolis, MN (US); Caleb Summers, Richfield, MN (US)

(73) Assignee: Love Your Melon Inc., Minneapolis, MN (US)

( * ) Notice: Subject to any disclaimer, the term of this patent is extended or adjusted under 35 U.S.C. 154(b) by 0 days.

(21) Appl. No.: 16/257,443

(22) Filed: Jan. 25, 2019

(65) Prior Publication Data

US 2020/0237056 A1 Jul. 30, 2020

(51) Int. Cl.
*A44B 17/00* (2006.01)

(52) U.S. Cl.
CPC ..... *A44B 17/0029* (2013.01); *A44B 17/0094* (2013.01)

(58) Field of Classification Search
CPC ..... A44B 17/0029; A44B 17/0094
See application file for complete search history.

(56) References Cited

U.S. PATENT DOCUMENTS 3,814,058 A * 6/1974 Thompson ..... A01K 1/033 119/482
3,860,209 A * 1/1975 Strecker ..... B60P 7/13 410/116
4,400,856 A * 8/1983 Tseng ..... B63B 25/28 24/590.1
4,562,624 A 1/1986 Kanzaka
4,577,376 A 3/1986 Clendinen
4,673,153 A * 6/1987 Hilty ..... A47F 7/06 211/30
6,009,601 A * 1/2000 Kaufman ..... A41F 1/002 24/303

(Continued)

FOREIGN PATENT DOCUMENTS

CN 1046666 A 11/1990
GB 2240134 A 7/1991
WO WO-2020154132 A1 7/2020

OTHER PUBLICATIONS

"International Application Serial No. PCT/US2020/013483, International Search Report dated Apr. 6, 2020", 5 pgs.

(Continued)

*Primary Examiner* — Jason W San
(74) *Attorney, Agent, or Firm* — Schwegman Lundberg & Woessner, P.A.

(57) ABSTRACT

Techniques for a snap receiver are provided. In an example, a snap receiver can include a snap receiver base, and a lock ring. The snap receiver base can include a first opening in a first major surface, the first opening configured to first receive a snap post, and a plurality of lock legs extending from a second major surface. The lock ring can include a plurality of irregular slots, configured to secure the snap receiver to a fabric. A distal end of each lock leg can be configured to pass through the fabric and through a first end of a respective slot of the plurality of irregular slots. A first rotation of the lock ring with respect to the snap receiver base can lock a distal end of each of the lock legs within a second end of the respective slot of the plurality of irregular slots.

20 Claims, 11 Drawing Sheets

(56) References Cited

U.S. PATENT DOCUMENTS

| | | | | |
|---|---|---|---|---|
| 6,170,131 | B1 * | 1/2001 | Shin | A41F 1/002 24/303 |
| 6,564,434 | B1 * | 5/2003 | Morita | A45C 13/1069 24/114.2 |
| 9,078,508 | B2 * | 7/2015 | Ramsey | A45C 11/22 |
| 9,756,930 | B2 * | 9/2017 | Hanchett | A45F 5/02 |
| 9,961,966 | B2 * | 5/2018 | Ryan | A44B 1/20 |
| 10,118,674 | B1 * | 11/2018 | Jeffrey | B63B 25/28 |
| 10,130,148 | B1 | 11/2018 | Au et al. | |
| 10,315,549 | B2 * | 6/2019 | Fiedler | F16B 27/00 |
| 10,413,046 | B2 * | 9/2019 | Hanchett | A45F 5/02 |
| 2002/0152590 | A1 * | 10/2002 | Lin | A45C 13/1069 24/303 |
| 2006/0010557 | A1 | 1/2006 | Rogers | |
| 2006/0010658 | A1 * | 1/2006 | Bigley | A44B 17/0029 24/114.05 |
| 2009/0089978 | A1 * | 4/2009 | Sugihara | A44B 17/0035 24/90.1 |
| 2013/0117972 | A1 | 5/2013 | Hasegawa et al. | |
| 2015/0013111 | A1 * | 1/2015 | White | H04R 1/025 24/3.1 |
| 2018/0070681 | A1 * | 3/2018 | Ryan | A44B 1/32 |
| 2018/0368531 | A1 | 12/2018 | Steinke | |
| 2020/0015534 | A1 * | 1/2020 | Warsaw | A42B 1/24 |

OTHER PUBLICATIONS

"International Application Serial No. PCT/US2020/013483, Written Opinion dated Apr. 6, 2020", 6 pgs.

* cited by examiner

SNAP FASTENER RECEIVER TECHNIQUES

TECHNICAL FIELD OF THE DISCLOSURE

Techniques for a fastener are provided, and in particular, techniques for a snap receiver are provided.

BACKGROUND

Snap fasteners allow units of material to be fastened together and are commonly found on different types of apparel as well as other devices made of cloth like material, such as, but not limited to, handbags, boat covers, backpacks, etc. A snap fastener allows for very quick joining of articles compared to lacing, buttons, clasps, etc. The fastener typically has two main components, the post assembly and a receiver assembly. In certain applications, each assembly can be connected to a corresponding piece of fabric by cinching the fabric between components of the assembly. Where cinching can be harmful to aesthetics or function of a device, one or more of the assemblies can be sown to the corresponding fabric.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

The present inventors have recognized a snap fastener receiver for knitted fabrics that can be assembled to a fabric quicker than sewn receivers, does not require thread or adhesive for assembly, can be assembled by hand, can resist disassembly, and can ameliorate stress and damage to device components as the components are unfastened.

Figure 1A:
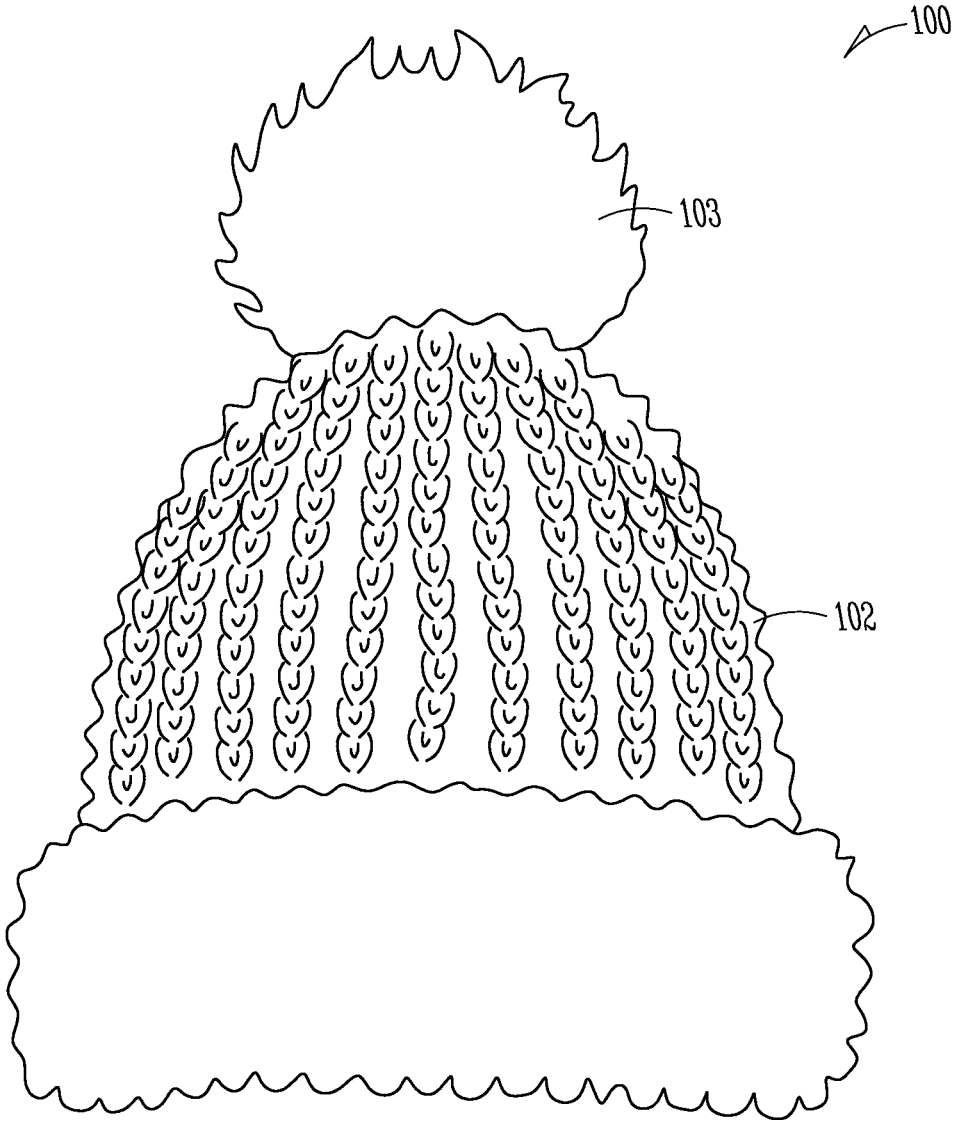
FIG. 1A illustrates an assembled system including an example snap receiver.

FIG. 1A illustrates an assembled system 100 including an example snap receiver 101. The system 100 can include an first fabric assembly 102 such as a knitted hat and a second fabric assembly 103 such as a pom. The second fabric assembly 103 can connect to the first fabric assembly 102 using a snap connector. the snap connector can include a snap post assembly 104 coupled to the second fabric assembly 103 and an example snap receiver 101 coupled to the first fabric assembly 102, or vice versa.

Figure 1B:
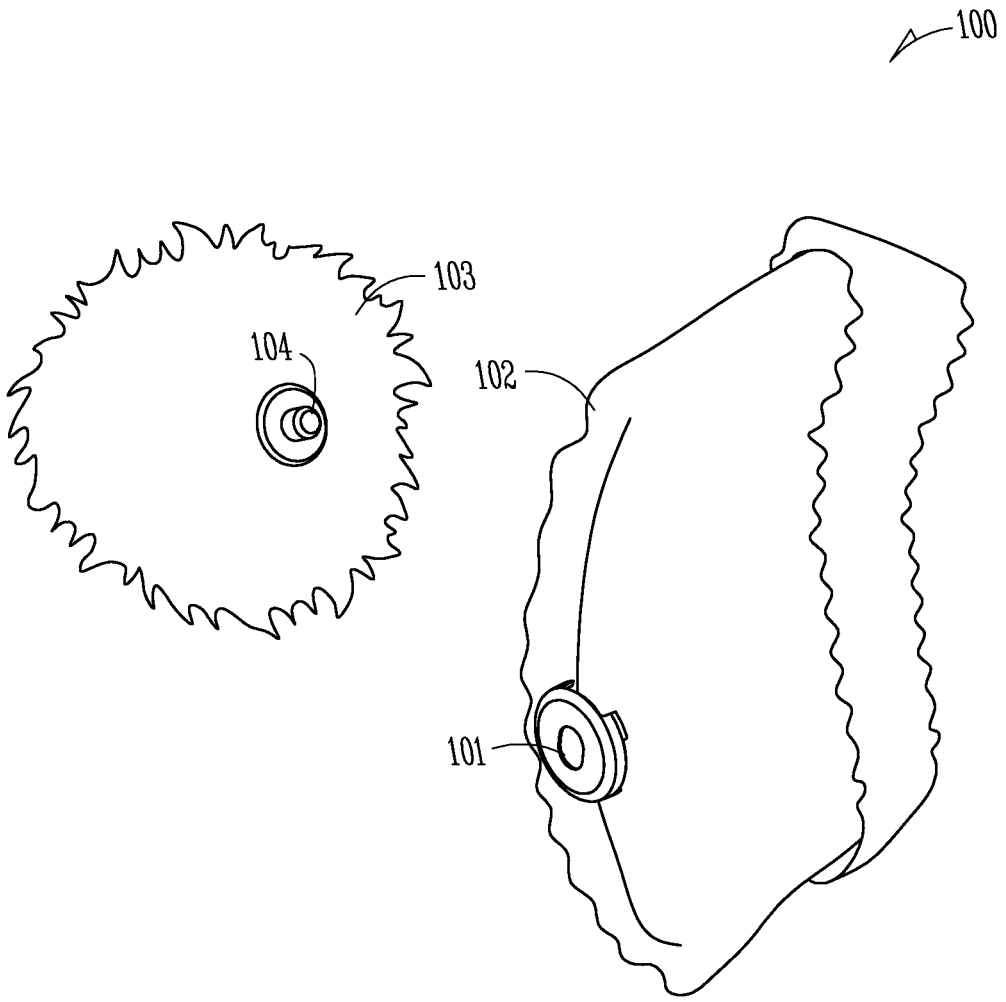
FIG. 1B illustrates generally the unassembled system of FIG. 1A.

FIG. 1B illustrates generally the unassembled system 100 of FIG. 1A. The system 100 includes the second fabric assembly 103 with the snap post assembly 104 and the first fabric assembly 102 with the example snap receiver assembly 101. The snap post assembly 104 can be attached to the second fabric assemble 103 via several methods including, but not limited to, using an adhesive, sewing, or combination thereof. The example snap receiver 101 is attached to the first fabric assembly 102 using aspects of the snap receiver 101 discussed below. Such aspects can allow the snap receiver 101 to be attached without sewing or applying adhesive to the first fabric assembly 102. Conventional head wear such as knitted hats typically have a snap receiver that is sewn, glued, tied or crimped to the hat. Such methods can require specially trained personnel to attach the snap receiver to the knitted fabric such that the snap receiver is secure, does not damage the treads or fibers of the fabric, is aesthetically pleasing, and does not interfere with a user's comfort such as can happen if adhesive, or a crimp connection captures a user's hair even when the snap receiver is properly attached.

Figure 2A:
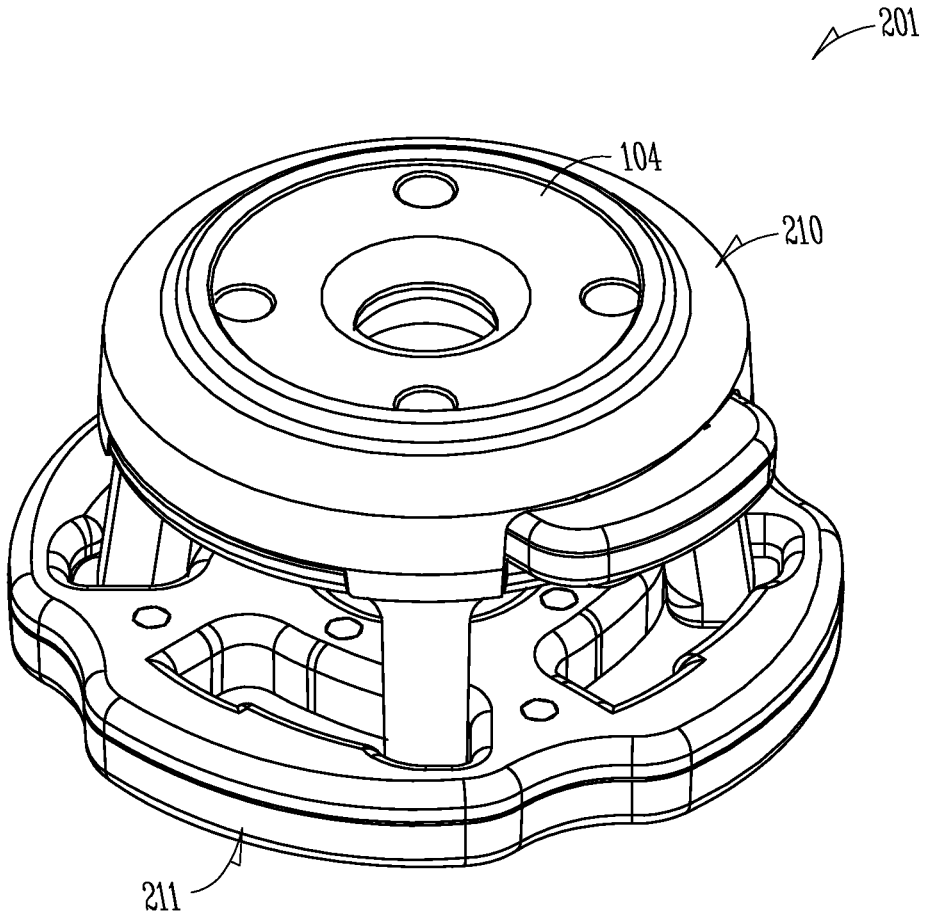
FIG. 2A illustrates generally an example snap receiver according to the present subject matter.
Figure 2B:
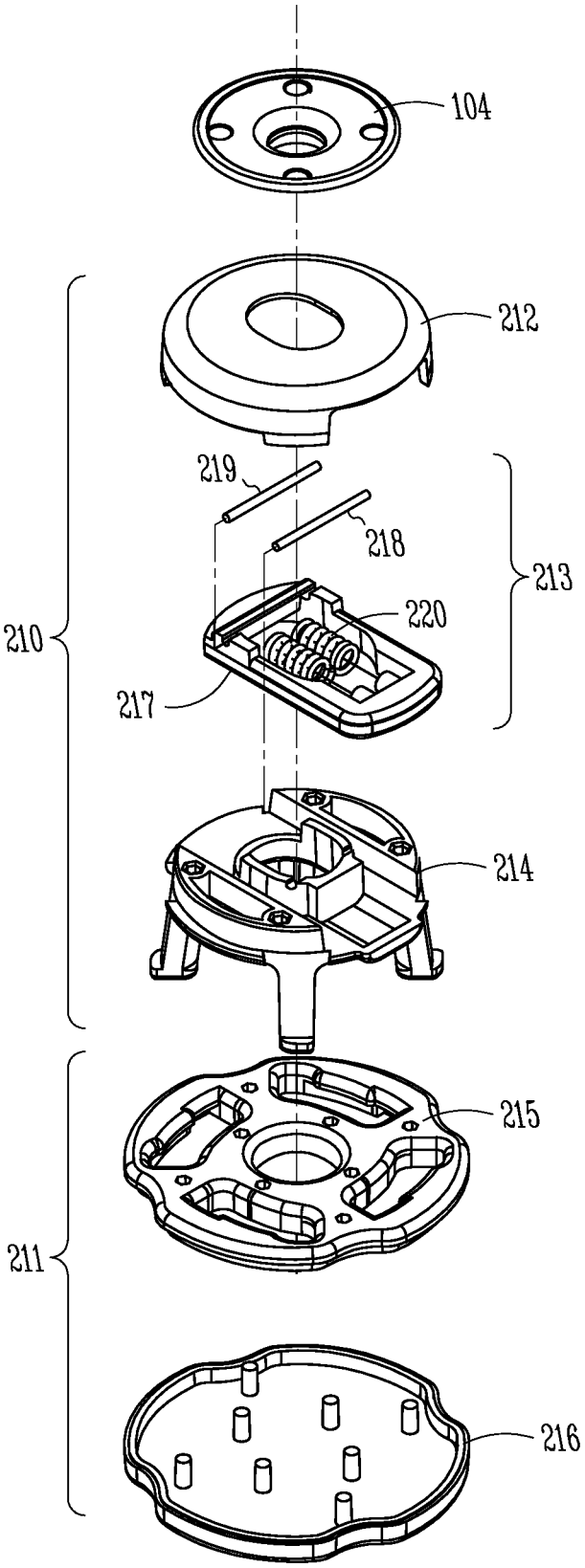
FIG. 2B illustrates generally an exploded view of the example snap receiver of FIG. 2A and includes a snap post assembly.

FIG. 2A illustrates generally an example snap receiver 201 according to the present subject matter. The snap receiver 201 can include a snap receiver base assembly 210 and a lock ring assembly 211. FIG. 2B illustrates generally an exploded view of the example snap receiver 201 of FIG. 2A and includes a snap post assembly 104. The snap ring base assembly 210 can include a base cover 212, a retainer assembly 213, and a snap receiver base 214. The lock ring assembly 211 can include a lock ring 215, a lock ring cover 216.

The base cover 212 can provide protection for the internal components of the snap receiver base assembly 210 such as for preventing foreign materials from entering and fouling the operation of the snap connector. In certain examples, the base cover 212 can include an opening for insertion and extraction of a snap post. In certain examples, the base cover 212 can include additional features to allow for efficient manufacturing of the base cover and for efficient assembly of the base cover 212 to the snap receiver base 214.

The retainer assembly 213 can include button actuator 217, a first retainer bar 218, a second retainer bar 219, and a spring assembly 220. The retainer assembly 213 is configured allow a bulbous portion of a snap post to be securely retained in the snap receiver 201. For example, upon entry of the snap post into the snap receiver 201, the bulbous portion of the snap post can be allowed to pass between the first and second retainer bars 218, 219. Upon passing between the first and second retainer bars 218, 219, the spring assembly 220 can apply force on a neck portion of the snap post using the first retainer bar 218. In a secure position, the snap post is retained in the snap retainer 201 via the first retainer bar 218 squeezing the neck portion of the snap post against the second retainer bar 219. The squeezing force maintains the distance between the first retainer bar 218 and the second retainer bar 219 defined by the diameter of the neck of the snap post. Typical snap posts include a neck portion that has a diameter that is the significantly less than the diameter of the bulbous portion of the snap post, consequently the first retainer bar 218, the second retainer bar 219 and the force exerted to squeeze the retainer bars 218, 219 together operate to retain the bulbous portion of the snap post within the snap receiver 201.

Figure 3:
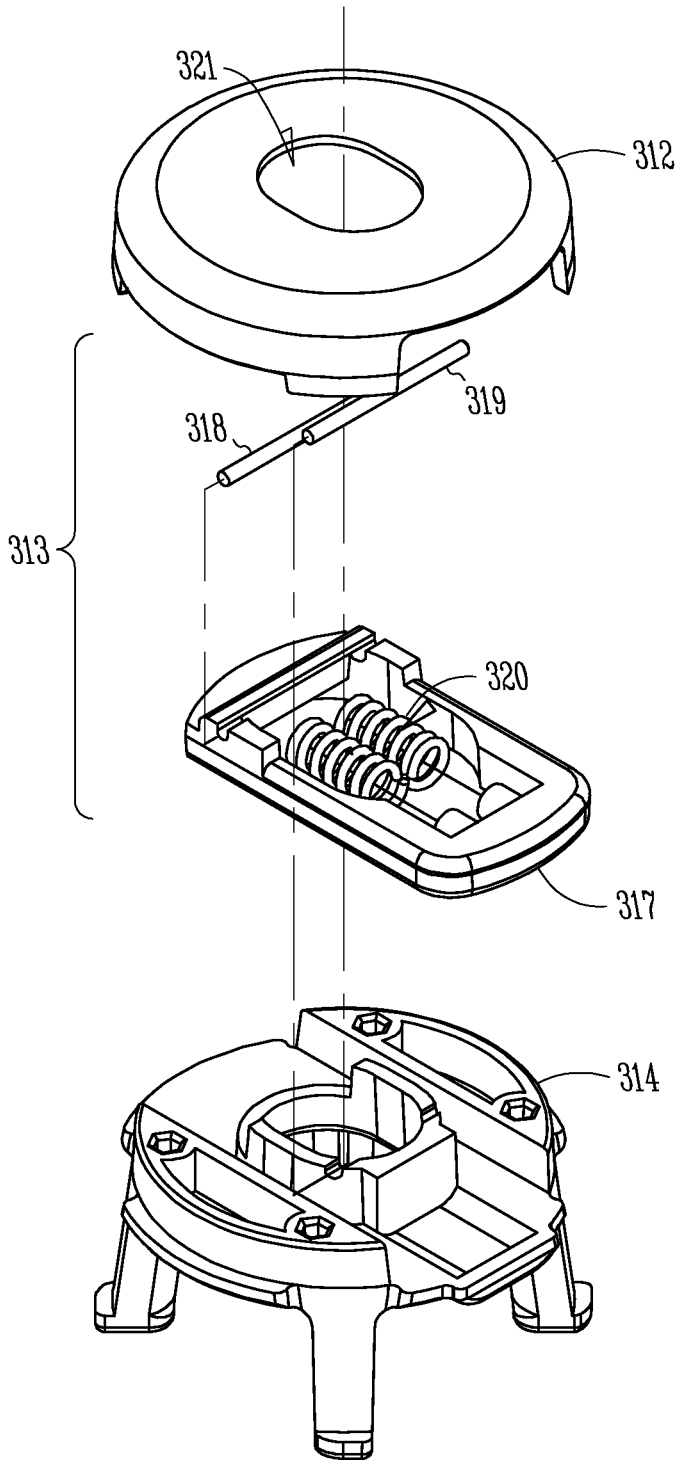
FIG. 3 illustrates generally an alternative example snap receiver base assembly 310.

FIG. 3 illustrates generally an alternative example snap receiver base assembly 310. The snap receiver base assembly 310 can include a base cover 312, a retainer assembly 313, and the snap receiver base 314. The base cover 312 can provide protection for the internal components of the snap receiver base assembly 310 such as for preventing foreign materials from entering and fouling the operation of the snap connector. In certain examples, the base cover 312 can include an opening 321 for insertion and extraction of a snap post. In certain examples, the base cover 312 can include additional features to allow for efficient manufacturing of the base cover 312 and for efficient assembly of the base cover 312 to the snap receiver base 314. In certain examples, the base cover 312 can include a slot in the side wall to facilitate a button actuator 317 of the retainer assembly 313.

The retainer assembly 313 can include button actuator 317, a first retainer bar 318, a second retainer bar 319, and a spring assembly 320. The retainer assembly 313 is configured allow a bulbous portion of a snap post to be securely retained in the snap receiver 301. For example, upon entry of the snap post into the snap receiver 301, the bulbous portion of the snap post can be allowed to pass between the first and second retainer bars 318, 319. Upon passing between the first and second retainer bars 318, 319, the spring assembly 320 can apply force on a neck portion of the snap post using the first retainer bar 318. In a secure position, the snap post is retained in the snap retainer 301 via the first retainer bar 318 squeezing the neck portion of the snap post against the second retainer bar 319. The squeezing force maintains the distance between the first retainer bar 318 and the second retainer bar 319 defined by the diameter of the neck of the snap post. Typical snap posts include a neck portion that has a diameter that is the significantly less than the diameter of the bulbous portion of the snap post, consequently the first retainer bar 318, the second retainer bar 319 and the force exerted to squeeze the retainer bars 318, 319 together operate to retain the bulbous portion of the snap post within the snap receiver 301.

In addition to carrying the first retainer bar 318 and allowing the first retainer bar 318 to move, the button actuator 317 can extend beyond the outer surface of the base cover 312 and can allow a user to separate the snap post 104 from the snap receiver 301 without requiring that the snap receiver 301 and snap post 104 to be pulled apart with a force sufficient to overcome the squeeze force of the first and second retainer bars 318, 319 as discussed above. In certain examples, operation of the button actuator 317 by a user can allow the snap post 104 to fall out of the snap receiver 301 with little if any separation force between the article attached to the snap post and the article captured by the snap receiver base 314 and the lock ring assembly 311. Such a reduced separation force can ameliorate wear and tear on each article compared to conventional snap connectors that can require a significant separation force between the first and second articles to overcome the retention mechanism of the conventional snap receiver. In certain situations, for example, where the snap connector couples a pom to a knitted hat or beanie, the separation force associated with conventional snap connectors can eventually damage either the pom or the knitted fabric of the hat or beanie.

The snap receiver base includes a number of structures extend from a first, or top, surface and two or more lock legs extending from a second, or bottom, surface. The structures extending from the first surface can provide rigidity, cooperate with the retainer assembly to provide the retention and release functionality discussed above and allow for attachment of the base cover. The lock legs extending from the second surface cooperate with the lock ring assembly to attach the snap receiver to a fabric and is discussed in more detail with reference to FIGS. 6A-6C.

Figure 4A:
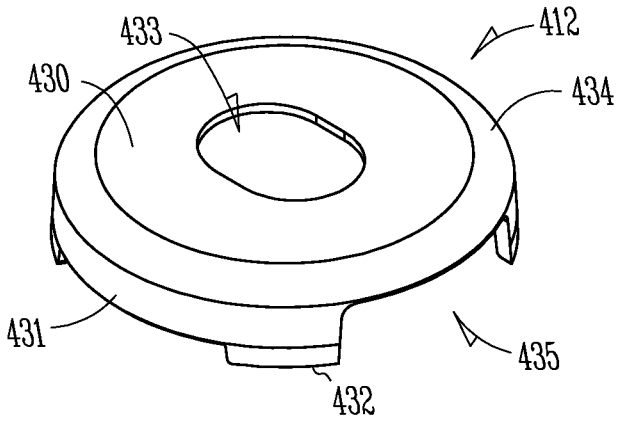
FIGS. 4A-4C illustrate generally different views of an example base cover 412.
Figure 4B:
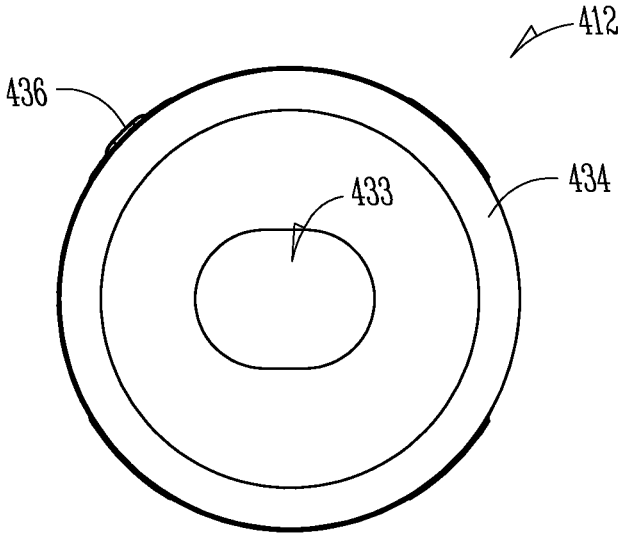
Figure 4C:
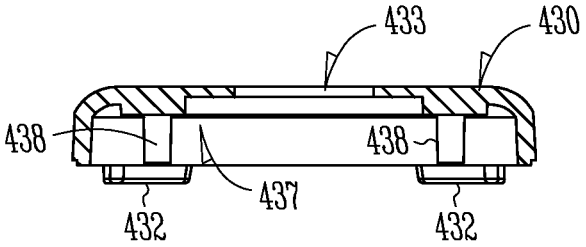

FIGS. 4A-4C illustrate generally different views of an example base cover 412. The base cover 412 can include cover layer 430 and one or more sidewalls 431. An exterior perimeter of the cover layer 430 can include a beveled or radiused surface 434 where the cover layer 430 meets the one or more side walls 431. The cover layer 430 can include an opening 433 to receive a snap post. In certain examples, one or more sidewalls 431 can include a cog 432 extending distally from the sidewall away 431 from the cover layer 430, the cog 432 can assist in orienting the base cover 412 when the snap receiver is assembled. In some examples, one or more cogs 432 can include an interior profile for latching the base cover 412 to the snap receiver base (e.g., FIG. 2, 214, FIG. 3, 313).

In certain examples, the base cover 430 can include an opening 435 in the one or more sidewalls 431 to accommodate exposing a portion of the button actuator (e.g., FIG. 2, 217, FIG. 3, 317) outside the base cover 412 such that a user can actuate the button actuator. In certain examples, one or more of the cogs 431 can include a tab portion 436 that radially extends further from a centerline of the base cover 412 than other cogs 431. Such a tab portion 436 can assist in manufacturing the base cover 412 and can be used, for example, for automatically ejecting the base cover 412 from a mold during the manufacturing process. Without the tab portion 436, the extraction of the base cover 412 from a manufacturing mold may not be able to be automated or automated in some other fashion that can result in a less efficiency.

In certain examples, an interior surface of the cover layer 430 can include a profile 437 configured to cap a central structure of the snap receiver base and to capture the second retainer bar within a slot of the snap receiver base. In certain examples, the interior surface of the cover layer 430 can capture the first retainer bar in slots of the button actuator. In certain examples, the interior surface of the cover layer 430 can include one or more posts 438. A post 438 can be used in cooperation with an opening in the snap receiver base to guide and secure the base cover 412 to the receiver base. In certain examples, a post 438 can include a vertical profile, such as a taper, to resist removal of the post 438 from the corresponding opening of the receiver base once the base cover 412 is assembled to the snap receiver base.

Figure 5:
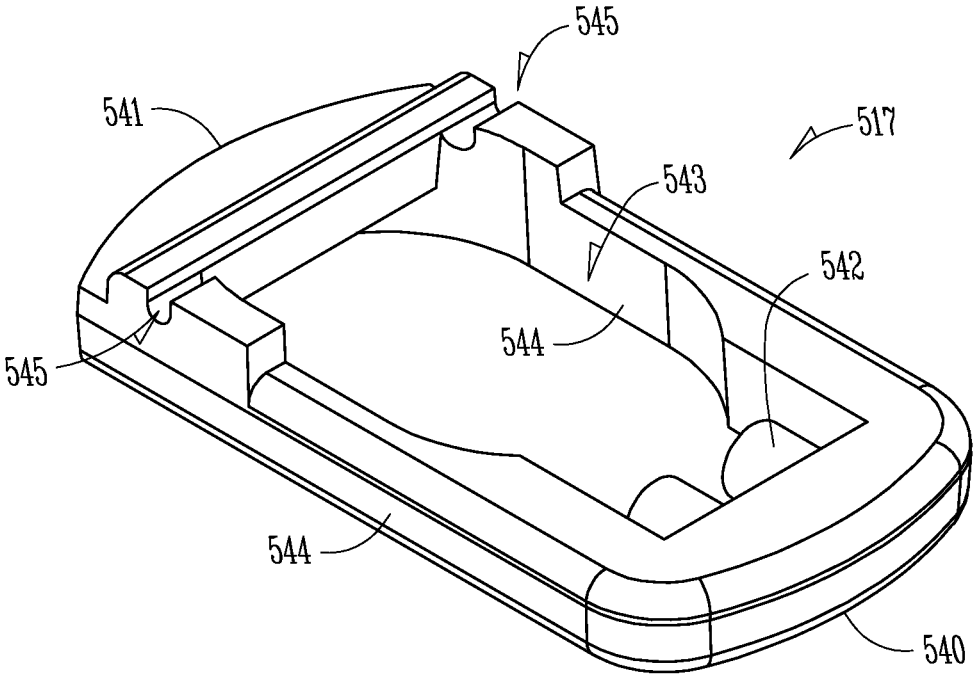
FIG. 5 illustrates generally a plan view of a button actuator.

FIG. 5 illustrates generally a plan view of a button actuator 517. The button actuator 517 can include a first end 540 that extends outside the base cover to allow the user to slide the button actuator 517 in a direction that overcomes the force of the spring assembly and separates first retainer bar from the second retainer bar. A second end 541 of the button actuator 518 can be configured to work in combination with a feature of the snap base to limit the travel of the button actuator 517 under the force of the spring assembly when the button actuator 517 is not activated (e.g., not being pressed by a user). In certain examples, the button actuator 517 can include features, such as one or more posts 542, to retain or guide components of the spring assembly. In certain examples, the button actuator 517 can include an opening 543 and sidewalls 544 that in cooperation with the snap receiver base restricts lateral movement of the button actuator 517 in directions other than the direction(s) used to receive and release the snap post. In certain examples, the button actuator 517 can include a slot 545 in each of two sidewalls 544 to hold the first retainer bar.

Figure 6A:
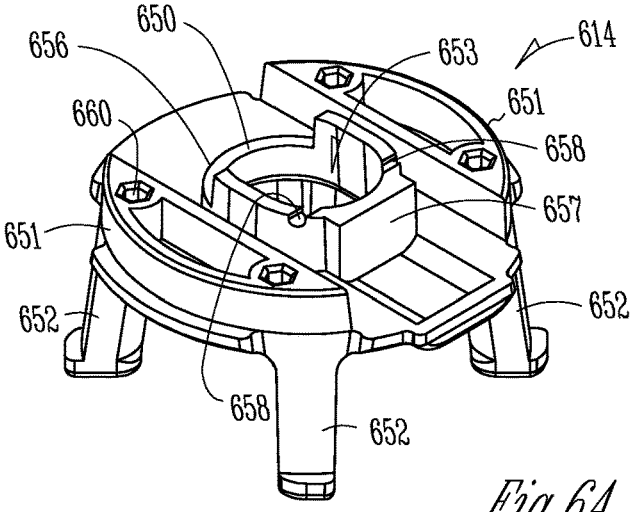
FIGS. 6A-6C illustrates generally an example snap receiver base according to the present subject manner.
Figure 6B:
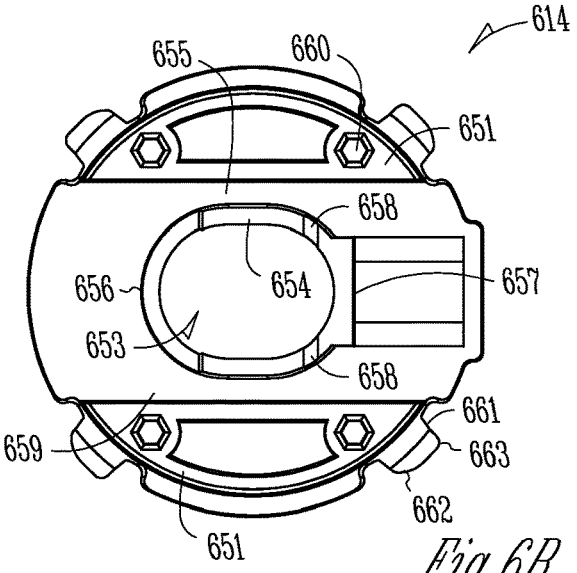
Figure 6C:
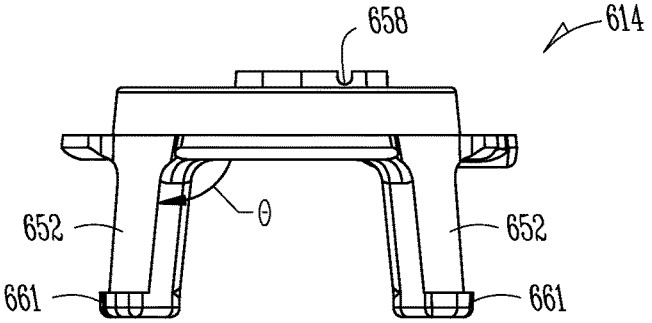

FIGS. 6A-6C illustrates generally an example snap receiver base 614 according to the present subject manner. The snap receiver base 614 can include a number of structures 650, 651 for interacting with the base cover and the retainer actuator on a top side, and a plurality of lock legs 652 extending from a second side. The structures 650, 651 on the first side of the snap receiver base can, among other things, facilitate entry of the snap post, interaction with the spring assembly, limiting or guiding the path of the button actuator, and holding the second retainer bar. For example, the structures can include a center structure 650 that includes a cylindrical-type opening 653. The opening 653 can accommodate entry of the snap post within the snap receiver. The opening 653 can also function as a relief area for seam material of the fabric to which the base receiver is attached via the lock ring assembly, and especially for seam material at an intersection of multiple seams. Seam material can be much denser than non-seam knitted material and can reduce comfort for a wearer if the material is compressed against the user either directly or via the lock ring. The opening 653 can provide space for some compression relief of seam material captured between the bottom of the snap receiver base and the lock ring.

First portions 654 of the exterior shape of the center structure 650 and the gap 655 between the other structures 651, can limit or guide motion of the button actuator to the directions for retaining and releasing the snap post between the retaining bars, and not lateral directions thereto. The center structure 650 can include a second portion 656 of a sidewall for limiting the travel of the button actuator when not activated. The center structure 650 can include a third portion 657 of the sidewall for providing a planer base for the spring structure of the retainer assembly.

The sidewall of the center structure 650 can include slots 658 for the second retainer bar. The height of the sidewall that includes the slots 658 is configured to cooperate with the interior surface of the cover layer of the base cover to capture the second retainer bar in the slots 658.

In certain examples, the structures of the first side of the snap receiver base 614 can include one or more second structures 651. The second structures 651 can provide stiffness and rigidity to the snap receiver base 614. Sidewalls 659 of the second structures 651 can operate as guides for the button actuator and limit lateral movement of the button actuator. In certain examples, the second structures 651 can include one or more openings 660 for receiving posts of the base cover. The openings 660 can help align the base cover to the snap receiver base 614 during assembly. In certain examples, a vertical profile, such as a taper of one or more of the openings 660 or posts can operate to resist separating once the base cover is assembled to the snap base receiver 614.

In certain examples, lock legs 652 can extend from the second side of the snap receiver base 614 and each leg can include a foot 661 that can be locked into a slot of the locking ring assembly to capture and couple the snap receiver base 614, and thus, the snap receiver, to a fabric such as a knitted fabric. In certain examples, the lock legs 652 can easily pass between threads of fabric such as between strands of yarn fiber of a knitted hat or beanie. The snap receiver base 614 can then be coupled to the knitted hat or beanie by inserting each foot 661 into a corresponding slot of the lock ring assembly and rotating the lock ring relative to the snap receiver base 614. In certain examples, the number of lock legs 652 and the spacing of the lock legs 652 about the snap receiver base 614 can be configured to accommodate seams of the fabric. For example, it can be more difficult to pass the lock legs 652 thru a seam of a fabric and, in certain examples, such as for a hat or beanie, 3 or more seams can come together at a desire location for the snap receiver. The spacing between the lock legs 652 can allow the seams to pass between adjacent lock legs 652.

In certain examples, the lock legs 652 can extend from the second surface of the snap receiver base 614 at a 90-degree angle. In some examples, the lock legs 652 can extend from the second surface of the snap receiver base 614 at an angle (Θ) greater than 90 degrees. In certain examples, an angle (Θ) of 95 degrees or larger can provide manufacturing benefits such as, but not limited to, reduced tool wear of the molding equipment used to form the snap receiver base compared to a snap receiver base having a smaller angle (Θ), a better part in terms smoothness and definition, better release of the snap receiver base from the molding equipment, or combinations thereof.

In certain examples, feet 661 of the lacking legs 652 can include a profile to interact with a slot of the lock ring. In certain examples, the profile can allow a foot 652 to be captured in the slot of the lock ring without being locked in the slot. In certain examples, when the feet 652 of the snap receiver base 614 have been inserted in the slots of the lock ring, the lock legs 652 are configured to deform in a spring like fashion as the lock ring is rotated relative to the snap receiver base 614. In such examples, the feet 661 can include a gentle, first radius 662 to provide a gradual deflection of the lock leg 652 as the lock ring is rotated. In certain examples, the feet 661 can include a second radius 663, or even a corner. The second radius 663 can operate in cooperation with a notch of the lock ring to lock the foot 661 of each lock leg 652 in a corresponding notch of each slot of the lock ring. In certain examples, the notch operates to at least partially relive spring tension of the deflection of the lock leg 652. However, due to the generally sharper, second radius 663 of the foot, the lock ring cannot be rotated in opposite direction with respect to the snap receiver base 614 to release the feet 661 without destructively deforming portions of the snap receiver. In addition, such rotation, if possible without deforming parts of the snap receiver, can require significantly more torque than required to lock the feet 661 in the slots of the lock ring.

Figure 7:
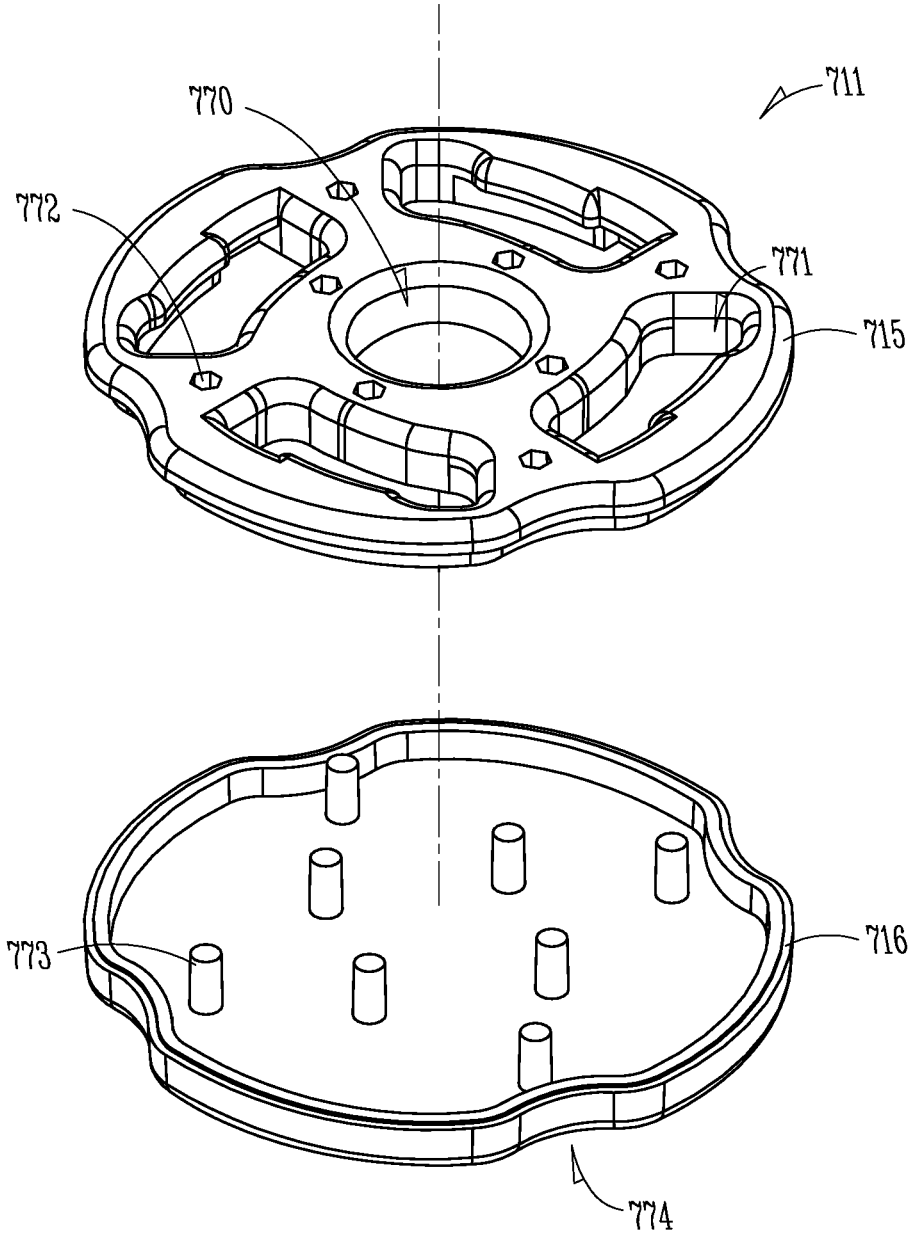
FIG. 7 illustrates generally an example lock ring assembly for an example snap receiver according to the present subject matter.

FIG. 7 illustrates generally an example lock ring assembly 711 for an example snap receiver according to the present subject matter. The lock ring assembly 711 can include a lock ring 715 and a lock ring cover 716. In certain examples, the lock ring 715 can include an optional central opening 770. The central opening 770 can accommodate material captured between the lock ring assembly 711 and the snap receiver base such as seam material that can be much denser than non-seam knitted material and can reduce comfort for a wearer if the material is compressed against the user either directly or via the lock ring 715. The central opening 770 can cooperate with the opening of the snap receiver base to provide space for some compression relief of seam material captured between the bottom of the snap receiver base and the lock ring 715. In certain examples, the lock ring 715 can include a plurality of slots 771. The slots 771 can receive and lock feet of a snap receiver base as discussed above. The slots 771 are discussed in more detail below with reference to FIGS. 8A-8C. In certain examples, the lock ring 715 can include optional openings 772 for posts 773 of the lock ring cover 716. In certain examples, the openings 772 can be tapered to receive the posts 773 and securely attach the lock ring cover 716 with the lock ring 715. In examples where the lock ring 715 does not include openings 772, or the lock ring cover 716 does not include posts 773, the lock ring cover 716 can be assembled with the lock ring 715 by, but not limited to, glue, clip connectors, etc. In certain examples, the exterior shape of the lock ring assembly 711 can include detents 774 to allow for the lock ring 715 to be manually rotated when assembling the lock ring assembly 711 with the lock legs of the snap receiver base.

Figure 8A:
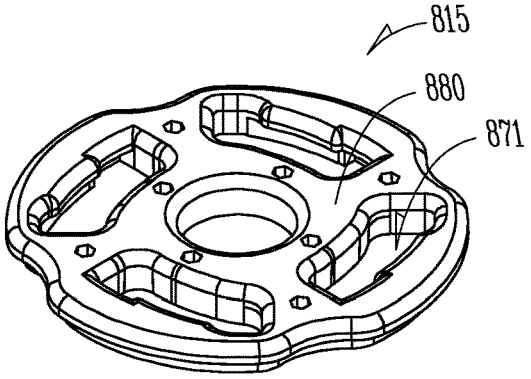
FIGS. 8A-8C illustrate generally an example lock ring of an example snap receiver according to the present subject matter.
Figure 8B:
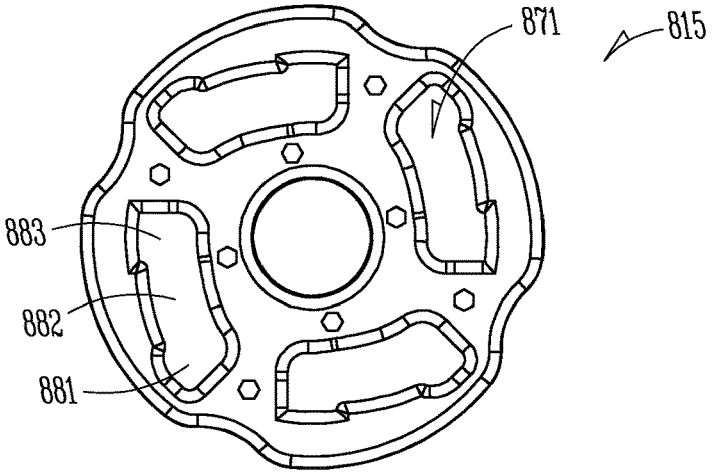
Figure 8C:
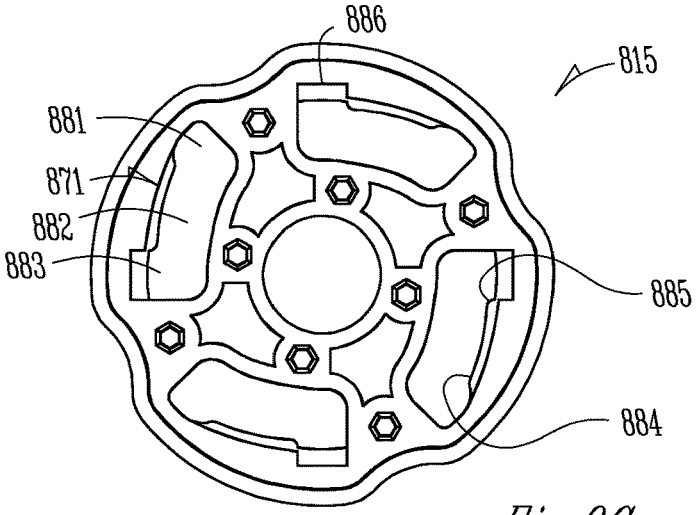

FIGS. 8A-8C illustrate generally an example lock ring 815 of an example snap receiver according to the present subject matter. FIG. 8A illustrates generally a perspective view of the lock ring 815 including an exposed first major surface 880 and a hidden second major surface. In certain examples, the first major surface 880 of the lock ring 815 can be the exposed surface of the lock ring assembly when the lock ring 815 is assembled with the lock ring cover. Also, the first major surface 880 of the lock ring 815 can be the surface most adjacent the second side of the snap receiver base when the lock ring 815 is assembled with the snap receiver base. FIG. 8B illustrates generally a top view of the lock ring 815 and the first major surface 880. FIG. 8C illustrates generally the second major surface of the lock ring 815. The lock ring 815 can include a plurality of slots 871 that in cooperation with the lock legs of the snap receiver base allow the snap receiver to be coupled and secured to a fabric.

In certain examples, a slot 871 can include a first end 881, a body 882, and a second end 883. The first end 881 of the slot 871 can receive and pass at least a portion of a foot of a lock leg. In certain examples, the lock ring cover can limit the depth at which the foot is received within the first end 881 of the slot 871, as well as, the depth of the foot in the body 882 and the second end 883 of the slot 871. The lock legs are locked in the lock ring 815 by rotating the lock ring 815 relative to the snap receiver base to move the foot from the first end 881 of the slot 871, thru the body 882 of the slot 871, and to the second end 883 of the slot 871. As the rotation first takes place to move each foot from the first end 881 to the body 882, the width of the body 882 of the slot 871 can narrow to allow an ankle of the lock leg to continue to move within the slot 871 but restricting the extraction of the foot from the interior of the lock ring assembly. Referring to FIG. 8C, the slot 871 can include a first gentle radius 884 at the transition of the first end and body of the slot. The first gentle radius 884 can act to capture the foot within the interior of the lock ring assembly while also beginning to deflect each of the lock legs toward the center of the snap receiver. The deflection is intended to spring load the lock legs. As the lock ring is further rotated, relative to the snap receiver base, the lock leg, ankle and foot can arrive at the second end 883 of the slot 871. The second end 883 of the slot 871 can widen compared to the body 882 of the slot 872. When the lock leg arrives at the second end 883, at least a portion of the spring load can be released when the lock leg springs radially outward to fill the widened portion of the second end 883 of the slot 871. However, a second sharper radius 885 of the slot 871 where the body 882 of the slot 871 meets the second end 883 of the slot 871, combined with the sharp angle of the foot or the ankle of the lock leg, resists allowing the lock ring 815 to rotate in a reverse direction relative to the snap receiver base. In addition, the second end 883 of the lock ring 871 includes a profile 886 that can capture the distal end of the foot, the toes of you will, within the interior of the lock ring assembly.

In certain examples, the cooperative operation of the snap receiver base and the lock ring assembly can allow the snap receiver to be easily and robustly coupled to a fabric of a garment without tools and with certainty that the lock ring will not easily be disassembled from the snap receiver base. Also, compared to a conventional sewing method of coupling a snap receiver with a fabric, the assembly of the example snap receiver with a fabric does not require specialized sewing skills and can be accomplished in a fraction of the time. In addition, when properly assembled, the snap receiver does not crimp the fibers of the fabric and thus, does not damage the fibers of the fabric. Finally, the ability to actuate a release of a snap post from the example snap receiver can alleviate damage to either fabric component coupled to the various components of the snap connector. With reference to FIGS. 1A and 1B, such fabric components can include a knitted hat, or beanie, and a pom.

Figure 9:
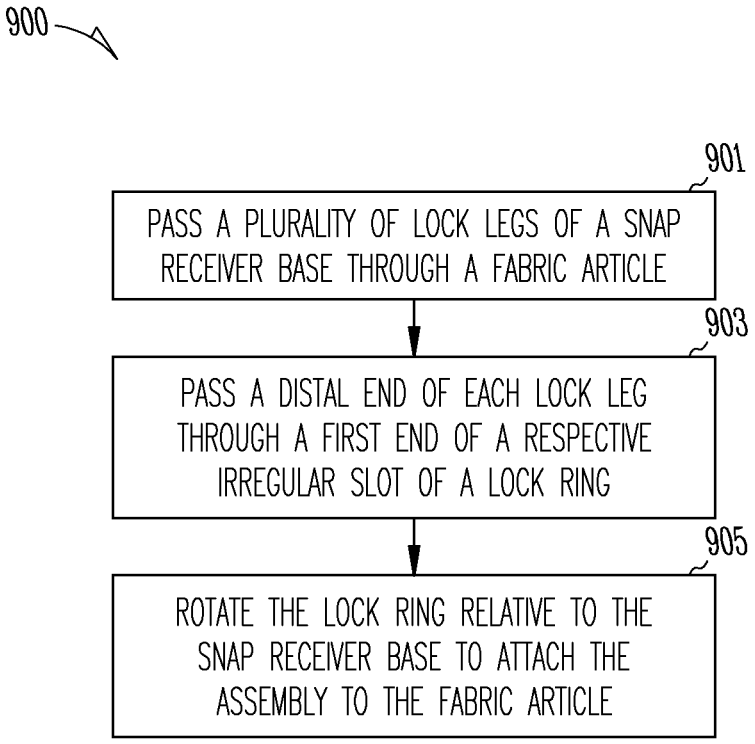
FIG. 9 illustrates generally a flowchart of an example method of operating an example snap receiver according to the present subject matter.

FIG. 9 illustrates generally a flowchart of an example method of operating an example snap receiver according to the present subject matter. At 901, optionally, lock legs of a snap receiver base of the snap receiver can be passed through a fabric article such as, but not limited to, a knitted fabric or article, a woven fabric or article, etc. In certain examples, the lock legs can be sized and shaped to pass between threads or between threads of yarn of the fabric so as not to damage the threads. In certain examples, the lock legs of the snap receiver can be separated from each other to allow seams of the article to pass between adjacent lock legs of the snap receiver base. At 903, a distal end, or foot, of each lock leg can pass through a respective or corresponding slot of a lock ring of the snap receiver. The slots can be irregular in shape to capture and control the distal end of each lock leg. At 905, the lock ring can be rotated relative to the snap receiver base, or vice versa, to assemble the lock ring with the snap receiver base to form an assembled snap receiver. When the lock legs are passed through the fabric prior to passing the distal ends of the lock legs through the slots of the lock ring, the assembled snap receiver can be coupled to the article.

In certain examples, the method 900 can improve efficiency of fabricating articles that include a snap receiver compared to conventional method of attaching a snap receiver with a knitted article. The method 900 can be accomplished without specialized training such as sewing training. The method 900 can be accomplished without using tools. Efficiency improvements over conventional methods can result from increased speed in attaching the example snap receiver to the knitted article, the robust connection made when the feet of the snap receiver base are locked in the second end of each slot of the lock ring, and the lack of damage avoided from not crimping or gluing the snap receiver to the fabric of the article.

In certain examples, a snap post can be inserted into the snap receiver. In some examples, the squeezing the snap post into the snap receiver can separate spring loaded retainer bars of the snap receiver to allow a bulbous portion of the snap post pass between the retainer bars. Once the bulbous portion passes through the retainer bars, the retainers bars can close about a neck or narrow portion of the snap post to secure the snap post, and accessories couple to the snap post, with the snap receiver. Separating the snap post from the snap receiver can be accomplished by pulling the snap post away from the snap receiver to overcome the spring-loaded retainer bar(s). In certain examples, at least one of the retainer bars of the snap receiver can be manually actuated to separate from the other retainer bar. Manually actuating a retainer bar can allow the snap post to be inserted and extracted from the snap receiver with little if any force being applied between the snap post and the snap receiver. Such a feature can reduce wear and tear on the articles coupled to the snap post and to the snap receiver.

ADDITIONAL NOTES AND EXAMPLES

Example 1 is an apparatus comprising: a snap receiver base including: a first opening in a first major surface, the first opening configured to receive a snap post; and a plurality of lock legs extending from a second major surface, the second major surface opposite the first major surface; a lock ring, including a plurality of irregular slots, configured to secure the apparatus to a fabric; wherein a distal end of each lock leg is configured to pass through the fabric and through a first end of a respective slot of the plurality of irregular slots; and wherein a first rotation of the lock ring with respect to the snap receiver base is configured to lock a distal end of each of the lock legs within a second end of the respective slot of the plurality of irregular slots.

In Example 2, the subject matter of Example 1 includes, wherein a torque of the first rotation is less than a torque of a second rotation of the lock ring with respect to the snap receiver base, wherein the second rotation is configured to unlock the distal end of each of the lock legs from the second end of the respective slot of the plurality of irregular slots.

In Example 3, the subject matter of Examples 1-2 includes, a retainer assembly located between the first major surface and the second major surface, wherein the retainer assembly is configured to retain the snap post in a first state, and to release the snap post in a second state.

In Example 4, the subject matter of Example 3 includes, wherein the retainer assembly includes a fixed retainer bar and a moveable retainer bar.

In Example 5, the subject matter of Example 4 includes, wherein the retainer assembly includes a button actuator having slots configured to hold the moveable retainer bar.

In Example 6, the subject matter of Example 5 includes, wherein the first opening includes sidewalls, a portion of the sidewalls having a planar exterior portion.

In Example 7, the subject matter of Example 6 includes, wherein the retainer assembly includes a spring located between the planar exterior portion and the button actuator, the spring configured to spring return the button actuator to the first state.

In Example 8, the subject matter of Examples 6-7 includes, wherein the sidewalls include a first slot and a second slot; and wherein the first and second slots of the sidewalls are configured to receive the fixed retainer bar.

In Example 9, the subject matter of Examples 3-8 includes, a cover configured to form the first major surface, the cover including the first opening for receiving the snap post; and a second opening configured to expose a portion of the retainer assembly for actuation of the retainer assembly from the first state to the second state.

In Example 10, the subject matter of Examples 1-9 includes, wherein a length of the lock legs is configured to attach the snap receiver base, via the lock ring, without damaging fibers of the fabric.

In Example 11, the subject matter of Examples 1-10 includes, wherein each slot includes a first sidewall having a relief configured to capture an end of a corresponding lock leg and to deflect the corresponding lock leg toward the center of the lock ring as the lock ring rotates thru the first rotation.

Example 12 is a method comprising: passing a plurality of lock legs of a snap receiver base through a knitted article; and passing a distal end of each lock leg through a first end of a respective irregular slot of a plurality of irregular slots of a locking ring, wherein a portion of the knitted article is located between the locking ring and a first major surface of the snap receiver base.

In Example 13, the subject matter of Example 12 includes, rotating the locking ring relative to the snap receiver base to secure the snap receiver base to the knitted article.

In Example 14, the subject matter of Example 13 includes, wherein rotating the locking ring relative to the snap receiver base includes moving each distal end of each lock leg of the plurality of lock legs from the first end of the respective irregular slot to a second end of the respective irregular slot.

In Example 15, the subject matter of Examples 13-14 includes, wherein rotating the locking ring relative to the snap receiver base includes moving each distal end of each lock leg of the plurality of lock legs from the first end of the respective irregular slot past a locking mechanism of the locking ring to a second end of the respective irregular slot.

In Example 16, the subject matter of Examples 13-15 includes, wherein rotating the locking ring relative to the snap receiver base includes rotating the locking ring relative to the snap receiver base manually and without benefit of a separate tool.

Example 17 is an apparatus comprising: a knitted fabric; an attachment including a snap post; a snap receiver configured to receive the snap post, the snap receiver comprising: a snap receiver base including: a first opening in a first major surface, the first opening configured to first receive a snap post; and a plurality of lock legs extending from a second major surface, the second major surface opposite the first major surface; and a lock ring, including a plurality of irregular slots, configured to secure the snap receiver to the knitted fabric; wherein a distal end of each lock leg is configured to pass through the knitted fabric and through a first end of a respective slot of the plurality of irregular slots; and wherein a first rotation of the lock ring with respect to the snap receiver base is configured to lock distal end of each of the lock legs within a second end of the respective slot of the plurality of irregular slots.

In Example 18, the subject matter of Example 17 includes, wherein the attachment includes a pom.

In Example 19, the subject matter of Examples 17-18 includes, wherein the knitted fabric comprises head wear.

In Example 20, the subject matter of Examples 17-19 includes, wherein the snap receiver is configured to attach to the knitted fabric without damaging fibers of the knitted fabric.

The above detailed description includes references to the accompanying drawings, which form a part of the detailed description. The drawings show, by way of illustration, specific embodiments in which the invention can be practiced. These embodiments are also referred to herein as "examples". Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In this document, the terms "a" or "an" are used, as is common in patent documents, to include one or more than one, independent of any other instances or usages of "at least one" or "one or more." In this document, the term "or" is used to refer to a nonexclusive or, such that "A or B" may include "A but not B," "B but not A," and "A and B," unless otherwise indicated. In the appended claims, the terms "including" and "in which" are used as the plain-English equivalents of the respective terms "comprising" and "wherein". Also, in the following claims, the terms "including" and "comprising" are open-ended. A system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. An apparatus comprising:

a snap receiver base including:

a first major surface;

a second major surface;

a first opening in the first major surface, the first opening extending through the second major surface and configured to receive a snap post; and a plurality of lock legs, each lock leg of the plurality of lock legs individually extending from the second major surface; the second major surface opposite the first major surface;

a lock ring, including a plurality of irregular slots, configured to secure the apparatus to a knitted fabric:

wherein a distal end of each lock leg is configured to pass through the knitted fabric and through a first end of a respective slot of the plurality of irregular slots; and wherein a first rotation of the lock ring with respect to the snap receiver base is configured to lock a distal end of each of the lock legs within a second end of the respective slot of the plurality of irregular slots.

2. The apparatus of claim 1, wherein a torque of the first rotation is less than a torque of a second rotation of the lock ring with respect to the snap receiver base; wherein the second rotation is configured to unlock the distal end of each of the lock legs from the second end of the respective slot of the plurality of irregular slots.

3. The apparatus of claim 1, including a retainer assembly located between the first major surface and the second major surface, wherein the retainer assembly is configured to retain the snap post in a first state, and to release the snap post in a second state.

4. The apparatus of claim 3, wherein the retainer assembly includes a fixed retainer bar and a moveable retainer bar.

5. The apparatus of claim 4, wherein the retainer assembly includes a button actuator having slots configured to hold the moveable retainer bar.

6. The apparatus of claim 5, wherein the first opening includes sidewalks, a portion of the sidewalk having a planar exterior portion.

7. The apparatus of claim 6, wherein the retainer assembly includes a spring located between the planar exterior portion and the button actuator, the spring configured to spring return the button actuator to the first state.

8. The apparatus of claim 6, wherein the sidewalks include a first slot and a second slot; and wherein the first and second slots of the sidewalk are configured to receive the fixed retainer bar.

9. The apparatus of claim 3, including a cover configured to form the first major surface, the cover including the first opening for receiving the snap post; and a second opening configured to expose a portion of the retainer assembly for actuation of the retainer assembly from the first state to the second state.

10. The apparatus of claim 1, wherein a length of the lock legs is configured to attach the snap receiver base, via the lock ring, without damaging fibers of the knitted fabric.

11. The apparatus of claim 1, wherein each slot includes a first sidewall having a relief configured to capture an end of a corresponding lock leg and to deflect the corresponding lock leg toward the center of the lock ring as the lock ring rotates thru the first rotation.

12. A method comprising:

passing a plurality of lock legs, individually extending from a first major surface of a snap receiver base, through a knitted article; and passing a distal end of each lock leg through a first end of a respective opening of a plurality of individual openings of a locking ring, wherein each individual opening is an irregular slot of a plurality of irregular slots of the locking ring, and wherein a portion of the knitted article is located between the locking ring and the first major surface of the snap receiver base.

13. The method of claim 12, including rotating the locking ring relative to the snap receiver base to secure the snap receiver base to the knitted article.

14. The method of claim 13, wherein rotating the locking ring relative to the snap receiver base includes moving each distal end of each lock leg of the plurality of lock legs from the first end of the respective irregular slot to a second end of the respective irregular slot.

15. The method of claim 13, wherein rotating the locking ring relative to the snap receiver base includes moving each distal end of each lock leg of the plurality of lock legs from the first end of the respective irregular slot past a locking mechanism of the locking ring to a second end of the respective irregular slot.

16. The method of claim 13, wherein rotating the locking ring relative to the snap receiver base includes rotating the locking ring relative to the snap receiver base manually and without benefit of a separate tool.

17. An apparatus comprising:

a knitted fabric;

an attachment including a snap post;

a snap receiver configured to receive the snap post, the snap receiver comprising:

a snap receiver base including:

a first opening in a first major surface, the first opening configured to first receive a snap post; and a plurality of lock legs extending from a second major surface, the second major surface opposite the first major surface; and a lock ring, including a plurality of irregular slots, configured to secure the snap receiver to the knitted fabric;

wherein a distal end of each lock leg is configured to pass through the knitted fabric and through a first end of a respective slot of the plurality of irregular slots; and wherein a first rotation of the lock ring with respect to the snap receiver base is configured to lock a distal end of each of the lock legs within a second end of the respective slot of the plurality of irregular slots.

18. The apparatus of claim 17, wherein the attachment includes a pom.

19. The apparatus of claim 17, wherein the knitted fabric comprises head wear.

20. The apparatus of claim 17, wherein the snap receiver is configured to attach to the knitted fabric without damaging fibers of the knitted fabric.

* * * * *